United States Patent [19]

Boucher

[11] 4,177,707

[45] Dec. 11, 1979

[54] ELECTRONIC MUSIC SYNTHESIZER

[76] Inventor: Gary R. Boucher, 11831 S. Willow Cir., Houston, Tex. 77071

[21] Appl. No.: 793,126

[22] Filed: May 2, 1977

Related U.S. Application Data

[63] Continuation-in-part of Ser. No. 601,509, Aug. 4, 1975, abandoned.

[51] Int. Cl.[2] ..... G10H 1/00

[52] U.S. Cl. ..... 84/1.01; 84/1.13; 84/1.26

[58] Field of Search ..... 84/1.01, 1.13, 1.18, 84/1.24, 1.26, 1.28; 179/1 SA, 1 SG, 1 SM, 1 SF, 1 SP, 1 SH, 1 S, 15.55 T, 1 J; 307/228, 271; 328/151, 22, 25

[56] References Cited

U.S. PATENT DOCUMENTS

| | | | |
|---|---|---|---|
| 3,603,809 | 9/1971 | Uchiyama | 307/228 |
| 3,634,625 | 1/1972 | Geohegan et al. | 179/1 SA |
| 3,681,756 | 8/1972 | Burkhard et al. | 179/1 SH X |
| 3,749,837 | 7/1973 | Doughty | 179/1 J |
| 3,781,479 | 12/1973 | Swoboda | 179/15.55 T |
| 3,810,106 | 5/1974 | Nadler et al. | 84/1.01 X |
| 3,860,760 | 1/1975 | Rittenbach | 179/15.55 T |
| 3,869,708 | 3/1975 | Schiffman | 179/15.55 T X |
| 3,894,463 | 7/1975 | Rochelean | 84/1.01 |

*Primary Examiner*—Ulysses Weldon

*Attorney, Agent, or Firm*—Arnold, White & Durkee

[57] ABSTRACT

A polyphonic electronic music synthesizer reproduces in real time complex sounds representative of musical instruments and other musical and non-musical sounds from an above-audio frequency signal. The synthesizer includes a sampling circuit for repetitively sampling the high frequency signal to thereby provide a series of samples, successive ones of the samples being produced by sampling the relatively high frequency signal at a rate of approximately once per cycle at instantaneous points in the cycle which are progressively displaced from the previously sampled points. A storage mechanism sequentially stores the samples, and a mechanism is provided for sequentially recombining each of the sample in real time to thereby produce the selected waveform at the desired audio frequency. Preferably, the sampling circuit is implemented digitally. Further, the described sampling technique is utilized to produce from a high frequency periodic waveform a periodic waveform having a waveshape similar to that of the high frequency waveform.

25 Claims, 12 Drawing Figures

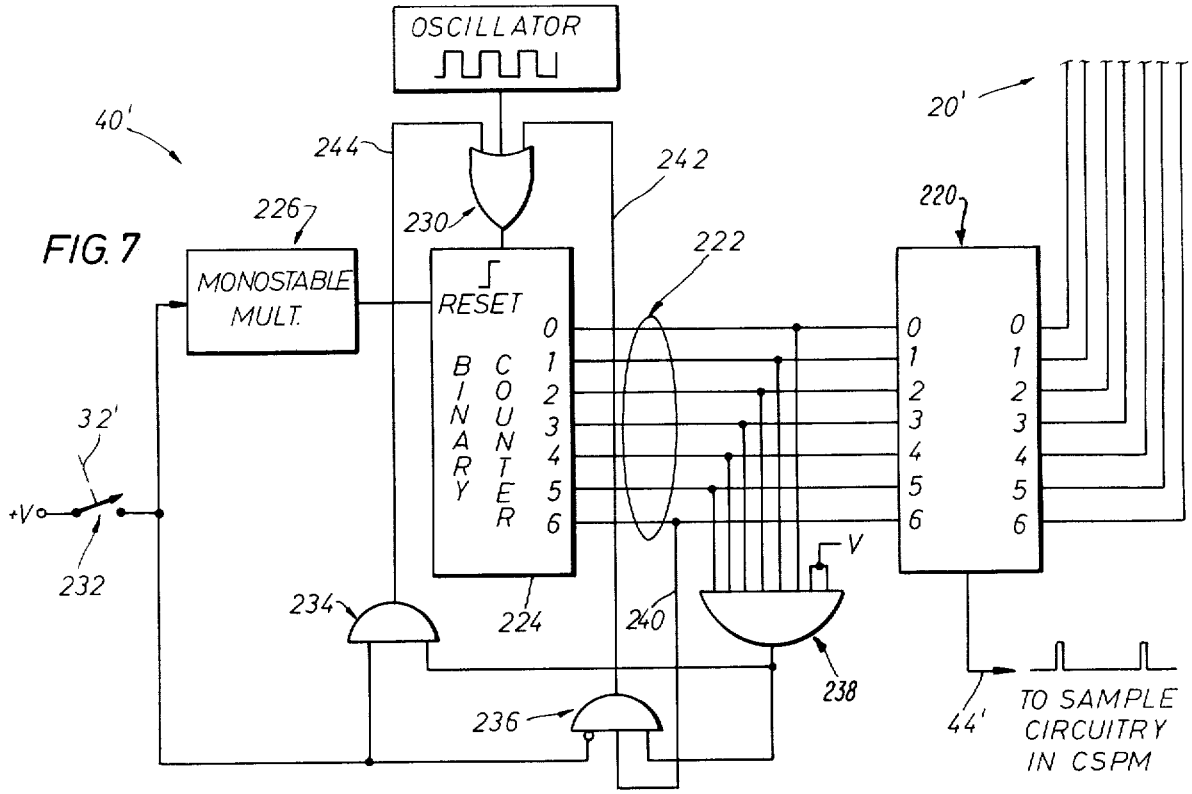
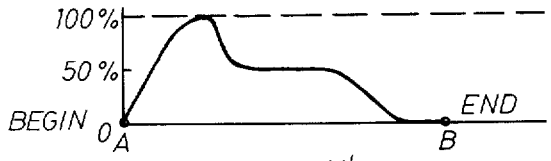
FIG. 8a
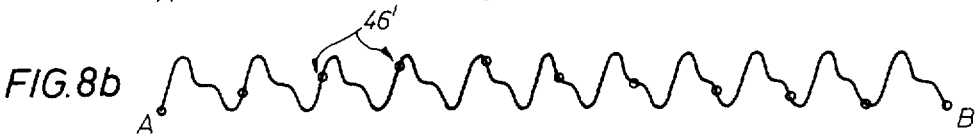
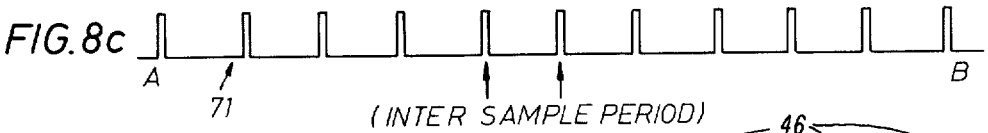
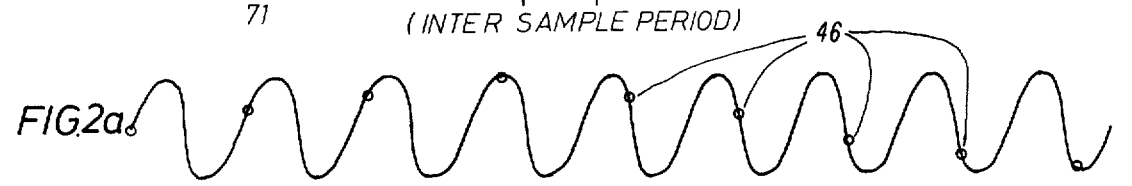
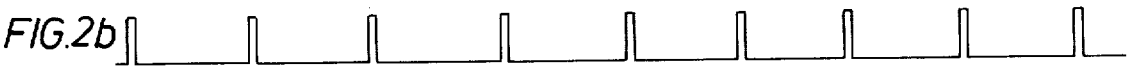
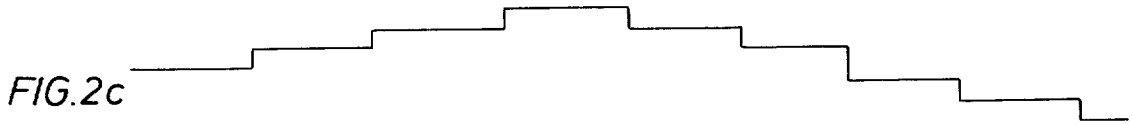

42
38
76
22
18
SIG. IN
SIG. OUT
74
SAMPLE AND HOLD
.001μf
44
GATE
72
60
BIT COMPARATOR 50
58
20
REFERENCE BUSS LINES
40
B. COUNTER
01
02
03
04
05
06
07
IN
52
56
OSCILLATOR
54
68
70
64
66
62
A

ELECTRONIC MUSIC SYNTHESIZER

BACKGROUND OF THE INVENTION

This application is a continuation-in-part of application Ser. No. 601,509, filed Aug. 4, 1975, and now abandoned, and entitled Electronic Music Synthesizer. The application Ser. No. 601,509 is expressly incorporated herein by reference.

The present invention relates to electronic musical synthesizers in general and more particularly relates to such synthesizers which generate audio sounds from above-audio frequency signals.

Various systems exist for reproducing or synthesizing sounds through electronic circuitry. These systems may simulate well-known musical instruments as well as other non-musical sounds, for example, wind, rain, etc. Typically, electronic music synthesizers have utilized the concept of filtering or subtractive synthesis, wherein signals having harmonic rich acoustic waveforms are passed through and are operated upon by low-pass or band-pass filters to remove selected harmonic components to reproduce a desired waveform.

Other synthesizers utilize the concept of additive synthesis wherein various simple acoustic waveforms are selectively added or mixed to reproduce a desired waveform.

These prior art synthesizers have tended to be relatively complex and thus expensive. The range of sounds which may be reproduced by prior art music synthesizers is directly related to the number of components needed to reproduce the sound variations and waveshapes desired. Moreover, utilizing conventional synthesizer technology a truly polyphonic synthesizer would require an inordinate quantity of components and subsystems. Accordingly, there has only been a limited market demand for such synthesizers.

The waveform defines the quality or timbre of the sound that is reproduced. It may be modified through modulation by an envelope signal, preferably aperiodic, to characterize the sound further by controlling various transient characteristics, for example, attack, decay, sustenance and release (ADSR) or merely attack and release (AR) to further simulate the sound of an actual or natural musical instrument. For example, trumpets have slower attack times and faster decay times than guitars.

The pitch or frequency of the waveform may be controlled before or after filtering or mixing. Various other controls may be provided, depending upon the degree of flexibility desired.

The pitch of the waveform is generally controlled by a keyboard or the like to enable a musician to control the synthesizer in a conventional manner. However, various devices, including the human voice may and have been used to control the pitch of the sounds reproduced by music synthesizers.

Sample and hold circuits have been used in the past, in oscilloscopes for example, to display waveforms which are faster than the frequency response limitations of the vertical amplifiers used therein. However, it is not believed that real time sampling circuits have ever been used heretofore to synthesize sounds in the audio range from an above-audio frequency signal.

SUMMARY OF THE INVENTION

The present invention provides method and apparatus for electronically synthesizing sounds in a manner which is relatively uncomplicated and inexpensive. This is accomplished by sampling a relatively high frequency signal at a sampling frequency according to a preselected relationship, and then by sequentially combining the samples in real time to provide the desired signal waveform at the desired audio frequency. This basic technique is also utilized to produce from a high frequency periodic signal an aperiodic signal having a waveshape similar to that of the high frequency signal, but with a period corresponding to an audio or subaudio frequency.

According to one aspect of the invention, the electronic sound synthesizer includes a signal generator for generating a periodic signal having a relatively high frequency Fm outside the audio range and having a waveshape similar to that of the disired signal waveform. A sampling circuit is provided for repetitively sampling the high frequency signal to thereby provide a series of samples. Successive ones of the samples are produced by sampling the relatively high frequency signal at a rate of approximately once per cycle at instantaneous points in the cycle which are progressively displaced from the previously sampled points. A storage mechanism is provided for storing the samples, and by combining the stored samples in real time, the selected waveform at the desired audio frequency Fa is generated.

Preferably, the sampling circuit includes a timing mechanism which effects the periodic sampling such that successive samples correspond to points on the high frequency signal which are equally time displaced from the previously sample point. This is accomplished by sampling the high frequency signal at a frequency Fs according to the relationship $Fs=Fm\pm Fa$.

In the preferred embodiment, the storage mechanism includes a sample and hold circuit for successfully storing and providing each of the samples in real time until the next sample in the series is produced.

According to another aspect of the invention, the sampling mechanism includes a timing circuit for generating timing pulses which determine when to sample the high frequency signal. The timing circuit includes a first signal generator for generating a first repetitive signal having cyclically varying values at a frequency corresponding to the relatively high frequency Fm. A second signal generator generates a second repetitive signal having cyclically varying values at a frequency substantially equal to the audio frequency Fa. It compares the first and second repetitive signals for generating the timing pulses in response to the substantial coincidence of the first and second repetitive signals.

Preferably, the first signal generator is the signal generator which generates the high frequency signal, and the second signal generator includes a binary counter for generating the second repetitive signals digitally. The first signal generator, however, may be implemented separately from the high frequency signal generator.

Alternately, the first and second signal generators may be implemented utilizing capacitors which are charged and discharged for generating the first repetitive signals to the analog.

According to the method of invention, electronic sounds are generated from an above-audio frequency F1 waveform to produce a desired signal waveform at a desired audio frequency F2. The method includes the steps of:

(a) generating a sampling signal at a frequency of Fm±Fa;

(b) sampling the high frequency signal at times determined by the sampling signal;

(c) sequentially storing the samples; and (d) sequentially recombining each of the samples to thereby produce the selected signal waveform at the audio frequency Fa.

Preferably the step of generating the sampling signal includes the steps of:

(a) generating a first repetitive signal having cyclically varying values at a frequency corresponding to the relatively high frequency;

(b) generating a second repetitive signal having cyclically varying values at a frequency substantially equal to the frequency Fa; and (c) generating the sampling signal substantially upon the coincidence of the first and second repetitive signals.

The first and second repetitive signals may be generated either as digital signals or as analog signals.

It is accordingly, a general object of the present invention to provide a new and improved music synthesizer which electronically generates audio sounds by sampling in real time an above-audio frequency signal.

Other objects, features and advantages of the present invention will become apparent from the following detailed description of a preferred embodiment when read in conjunction with the accompanying drawings wherein:

BRIEF DESCRIPTION OF THE DRAWINGS

FIGS. 2*a*–2*c* are exemplary waveforms illustrating operation of the synthesizer of FIG. 1;

FIG. 7 is a circuit diagram of pulse generating circuitry utilized in the circuitry of FIG. 6; and FIGS. 8*a*–8*c* are exemplary waveforms illustrating operation of the circuitry of FIG. 6.

DETAILED DESCRIPTION OF A PREFERRED EMBODIMENT

Figure 1:
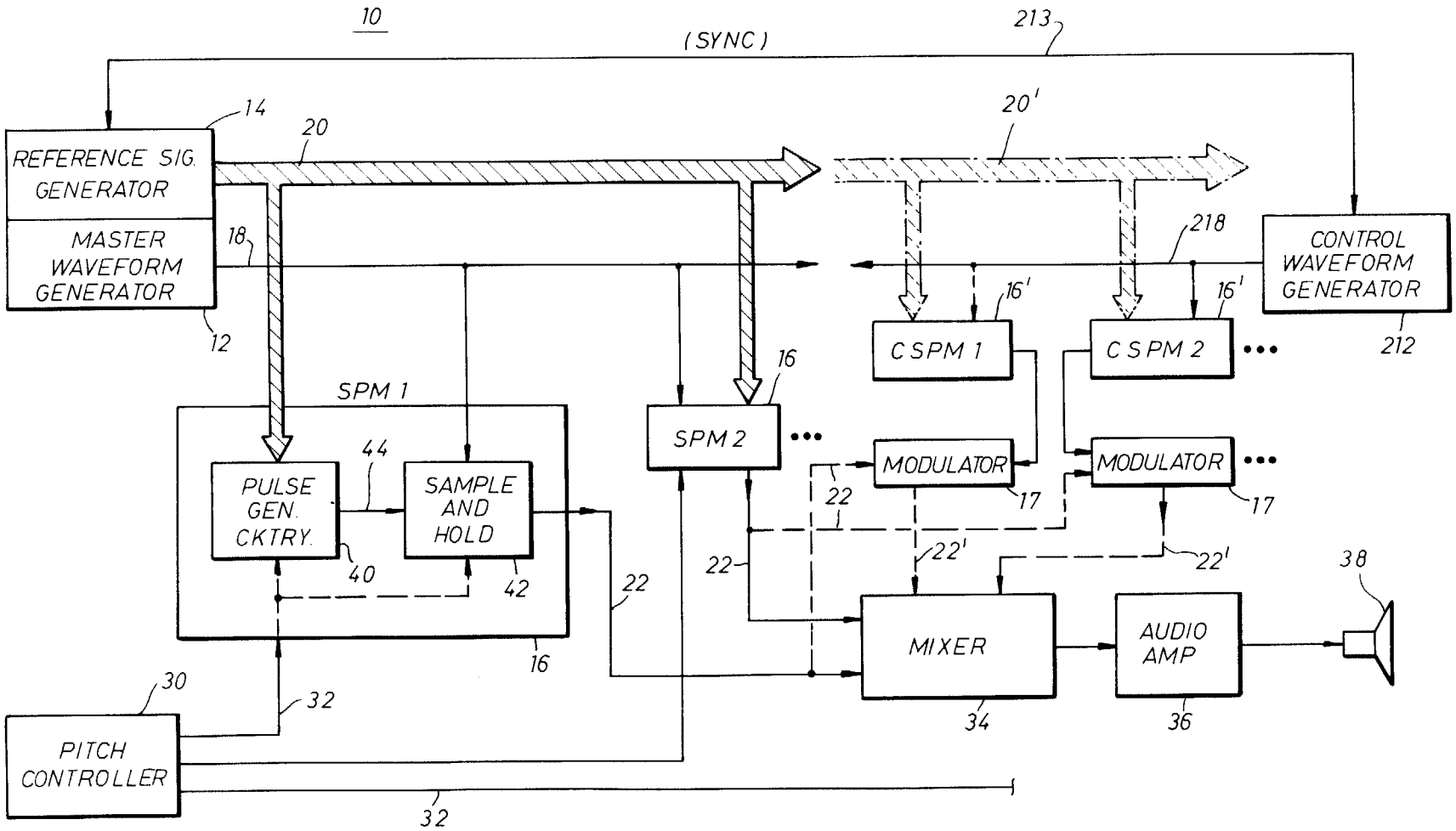
FIG. 1 is a block diagram of a polyphonic electronic music synthesizer in accordance with the principles of the present invention.

Referring now to FIG. 1, a polyphonic electronic music synthesizer 10 is shown in block diagram form for reproducing complex sounds representative of musical instruments and other musical and non-musical sounds. By sampling in real time an above-audio frequency waveform, and by serially combining the samples, the desired complex sound in the audio frequency is achieved.

The synthesizer 10 includes a master waveform generator 12, a reference signal generator 14, and a plurality of signal processing modules (hereafter SPM) 16. The master waveform generator produces a complex waveform at a relatively high, usually above audio, frequency. For example, the waveform generator 12 may produce a complex waveform, full of rich harmonics, with a fundamental frequency on the order of 30 Khz. For illustrative purposes only, FIG. 2*a* represents one version of a complex waveform in the form of a sine wave. It is understood that usually more complex waveforms are provided by the waveform generator 12.

The waveform generator 12 may be implemented by any of a variety of conventional waveform generators. For example, it could be implemented utilizing a digital system which is constructed and arranged to produce digital words from a memory to a digital to analog converter which generate an analog signal corresponding to the value of the digital words. On the other hand, an analog signal may be directly produced utilizing conventional flying spot scanner techniques. Both such systems are disclosed and described in detail in the parent application Ser. No. 601,509.

The reference signal generator 14 is implemented utilizing conventional techniques and generates a repetitive signal having cyclically varying values. This reference signal is generated at a frequency Fr corresponding to the frequency Fm of the master waveform signal. For example, the reference signal may either be analog or digital, depending on the implementation of the SPM's 16, having a repetition rate/frequency equal to that of the master waveform signal so that one cycle of the values of the reference signal coincides in time with one cycle of the master waveform signal; i.e., the frequency Fr produces one entire count of values in a period 1/Fm.

A line 18 is provided for coupling the master waveform signal from the generator 12 to the SPM's 16. A buss 20 is provided for coupling the reference signal from the generator 14 to the SPM's 16. The line 18 and the buss 20 may include conventional voltage amplifiers and signal equalizers if desired to enhance the quality of the signals appearing thereon.

Each SPM 16 includes circuitry for generating on a line 22 an audio frequency signal having the same wave shape as that of the master waveform on the line 18. Each SPM 16 operates to repetitively sample the high frequency, master waveform to provide a series of samples, successive ones of the samples being produced by sampling the high frequency master waveform at a rate of approximately once per cycle at instantaneous points in the cycle which are progressively displaced from the previously sampled points. Such sampling points are indicated in FIG. 2*a* at 24. Preferably, each SPM 16 operates to sample the master waveform at a rate according to the relationship $$Fs = Fm \pm Fa \qquad \text{Equation 1}$$

where Fs is the sampling frequency, Fm is the relatively high frequency of the master waveform, and Fa is the desired frequency in the audio range.

In order to select the SPM with the desired pitch, each SPM 16 is coupled to a pitch controller 30 via a line 32. The pitch controller 30 usually takes the form of a key board and is operative to selectively initiate/disable/maintain operation of the SPM 16.

An audio mixer 34 and an audio amplifier 36, both of conventional design, are responsive to the audio signals on the lines 22 for providing the desired synthesized audio signal to a speaker 38 for listening enjoyment.

In the preferred and illustrated embodiment, each SPM 16 includes pulse generating circuitry 40 and sample and hold circuitry 42. The pulse generating circuitry 40 is responsive to the master waveform on the buss 20 for generating a series of sample pulses on a line 44 to the sample and hold circuitry 42. The series of sample pulses is shown in FIG. 2*b*, and the relationship between generation of the pulses may be seen by comparing the master waveform in FIG. 2*a* with the pulses in FIG. 2*b*. More specifically, the pulse generating circuitry 40, assuming the relatively high frequency of the master waveform to be denoted by Fm, and assuming the desiring audio frequency to be denoted by Fa, then the pulse generating circuitry 40 produces the series of sampling pulses at a sampling frequency Fs according to the relationship:

$$Fs = Fm \pm Fa$$

Thus, as seen in FIG. 2*a*, the sampled points, as denoted by the numeral 46, are seen to be progressively spaced on a per cycle basis from the sample point of the previous cycle. Still more specifically, the master waveform is sampled at a rate substantially once per cycle such that the sampled point in each cycle is slightly displaced from the previously sampled point in the previous sample. The greater the spacing, i.e., the less the sampling frequency, the higher the audio frequency reconstructed and conversely. Of course, the closer the sampling points the more exact the reconstruction for exactly reproducing an audio signal having the exact wave shape of the high frequency waveform.

The sample and hold circuitry 42 is responsive to the series of sampled pulses and to the reference signal on the line 18 for generating the desired audio signal at the frequency Fa. This signal is seen in FIG. 2*c* and is seen to be the reconstruction of three-quarters of one cycle of the waveform depicted in FIG. 2*a*.

Figure 3:
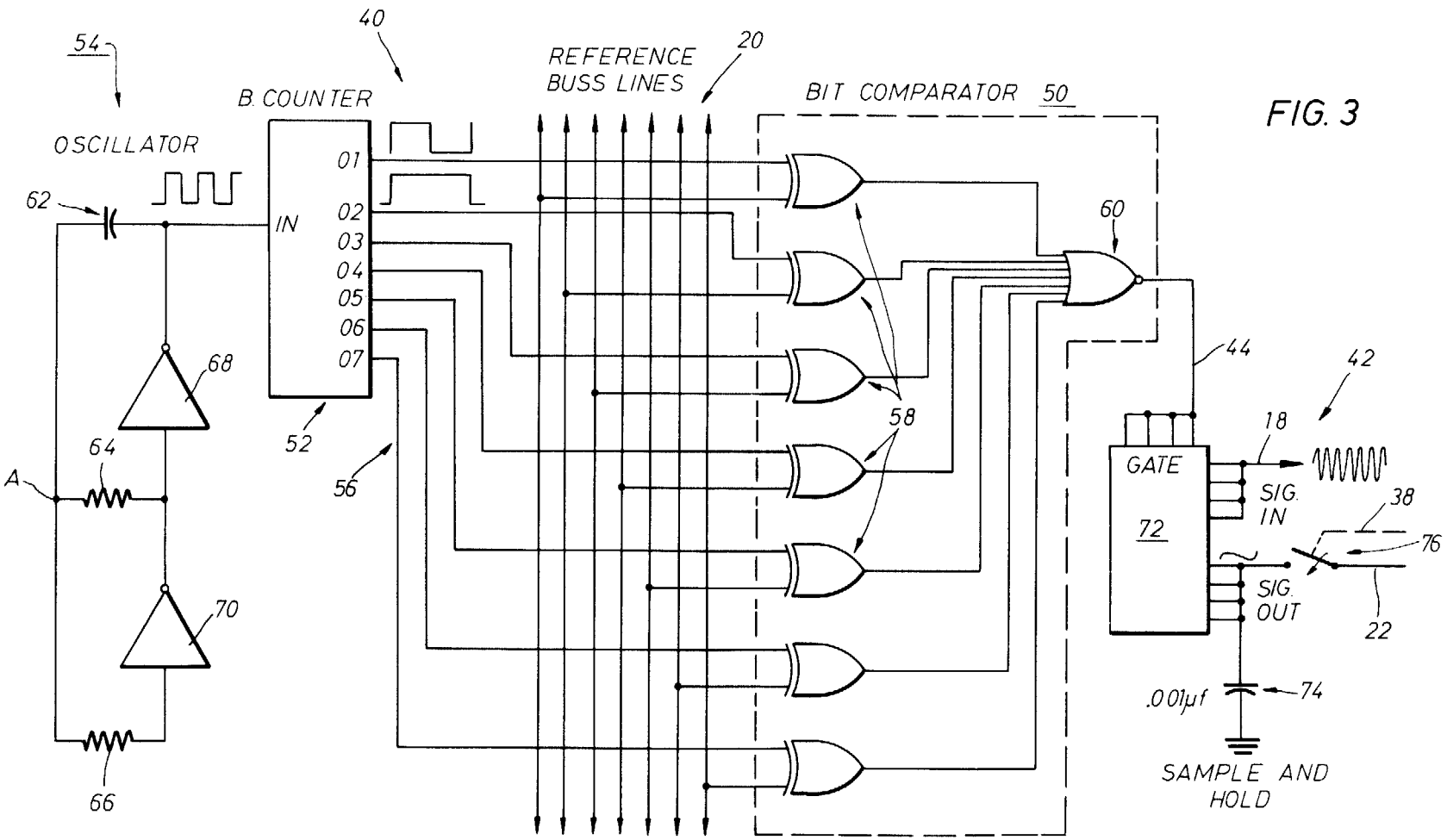
FIG. 3 is a circuit schematic of pulse generating circuitry utilized in the synthesizer of FIG. 1.

Referring now to FIG. 3, a specific circuit is shown for implementing the pulse generating circuitry 40 and the sample and hold circuitry 42. The circuitry 40 is preferably implemented digitally utilizing a comparator 50, a binary counter 52, and an oscillator 54. The comparator 50 is responsive to the reference signal on the line 18 and to the output signals on a set of lines 56 from the counter 52. Whenever a signal level developed on the reference buss lines 18 is coincident with the value of the signals developed on the line 56, the bit comparator 50 generates the series of sample pulses (see FIG. 2*b*) to the sample and hold circuitry 42. Since the reference signal on the buss 20 has a period coordinated with the period of the master waveform on the line 18, the series of sample pulses on the line 44 achieves a generally uniform sampling in time of the reference signal after many cycles.

The bit comparator 50 includes a plurality of EXCLUSIVE-OR circuits 58 and a logic NOR gate 60. The EXCLUSIVE-OR circuits 58 have their inputs coupled to the lines 20, 56 and have their output lines coupled as inputs to the NOR gate 60. The output of the NOR gate 60 is on the line 44.

The counter 52 is a conventional binary counter and has its input terminal coupled to the oscillator 54. The signals produced on the line 56 by the counter 52 cyclically range from seven bits of zeros to seven bits of ones.

The oscillator 54 is also conventional. A capacitor 62 and a pair of resistors 64, 66 are commonly connected at a node A. A pair of gates 68, 70 are provided and respectively connect the other terminals of the capacitor 62 and the other terminals of the resistors 64 and 66. The common connection of the capacitor 62 and the gate 68 is connected to the input terminal of the counter 52.

The oscillator 54 is tuned to operate at the frequency Fr which produces an entire count of values in a period 1/Fm to produce the sample pulse according to the Equation 1.

The sample and hold circuitry 42 includes a conventional bi-directional switch 72 having its gating input terminals connected to the line 44. The primary signal input terminals of the switch 72 are connected to the line 18 for receiving the high frequency master waveform. The primary signal output terminals of the switch 72 are connected through a capacitor 74 to circuit ground and via a switch 76 to the line 22. A standard SN 4016 part is utilized as the switch 72.

In operation, the sample pulses on the line 44 cause the master waveform on the line 18 to be periodically sampled, held, and output onto the line 22 whenever the switch 76 is closed. As seen in FIG. 3, the switch 76 is operated via the pitch controller 30 and corresponding lines 32. The reconstructed audio waveform generated on the line 22 is depicted in FIG. 2*c*.

Figure 4:
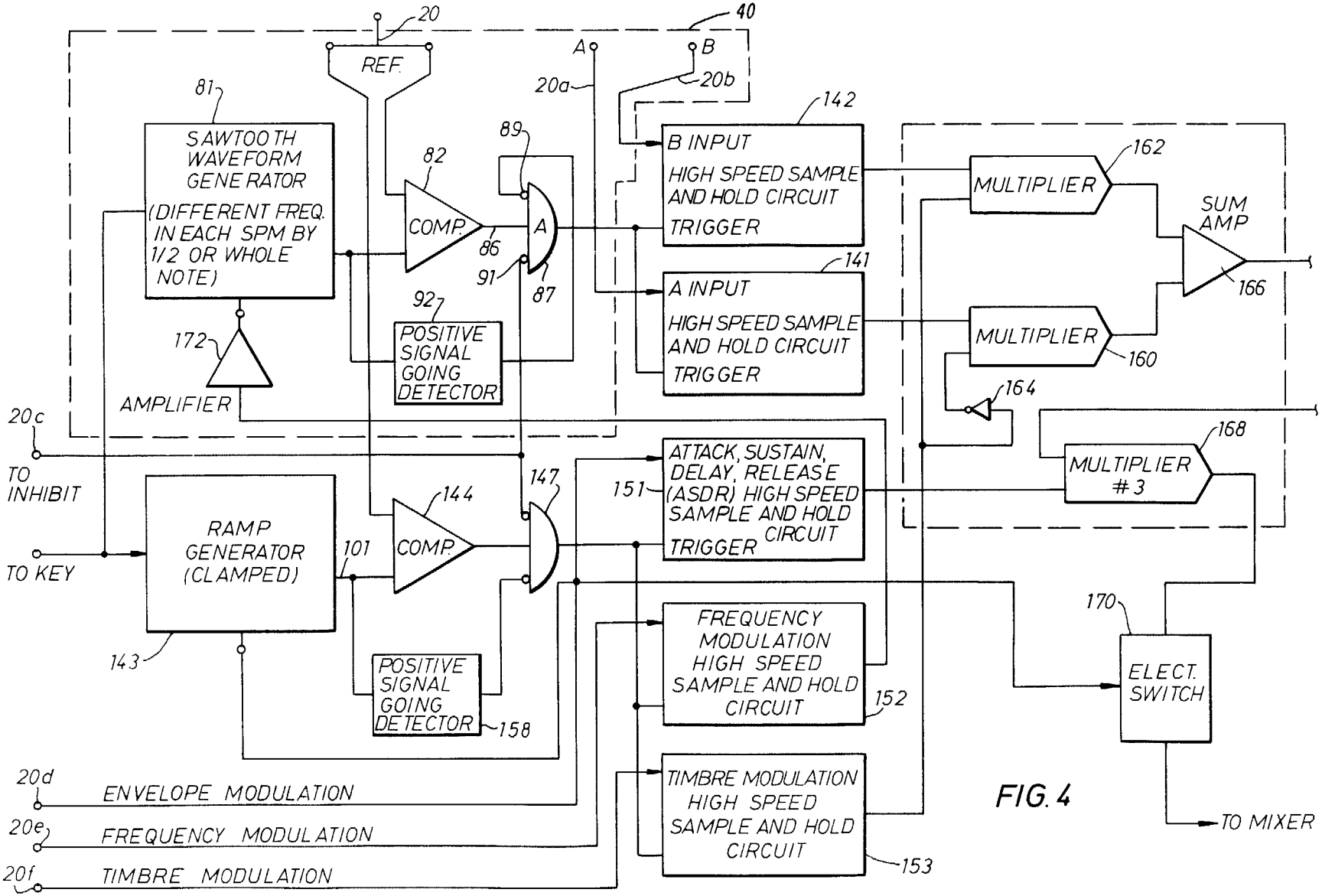
FIG. 4 is a block diagram of an analog version of pulse generated circuitry utilized in the synthesizer of FIG. 1.

FIG. 4 depicts another embodiment of the pulse generating circuitry 40. This version of the circuitry 40 is analog in nature, and thus is used in association with a reference signal generator 14 which produces an analog reference signal on the buss 20.

The circuitry 40 includes a negative voltage sawtooth generator 81, which has an audio frequency which differs from the frequency of an adjacent SPM 16 by a half-note or a whole note in the musical scale which may be just or even-tempered.

The output of the sawtooth generator 81 is coupled to an input of a window comparator 82 which has its other input coupled to the buss line 20 on which appears a relatively high speed sawtooth reference signal. It will be appreciated that the frequency of each such sawtooth generator 81 is many times lower than the reference sawtooth frequency appearing on the buss line 20. The output of the window comparator is coupled to an input 86 of an AND gate 87, which has first and second inverted inputs 89 and 91 coupled to an inhibiting signal on the buss line **20*c* and to the output of a positive-going detector circuit 92, respectively. The input of the positive-going detector circuit 92 is coupled to the output of the sawtooth generator 81**.

The positive-going detector circuit 92 may include an RC circuit consisting of a capacitor and a resistor coupled to a diode. When the low frequency sawtooth signal from the sawtooth signal from the sawtooth generator 81 starts to go positive, the positive going detector circuit 92 produces a positive pulse as an inhibiting signal.

Figure 5:
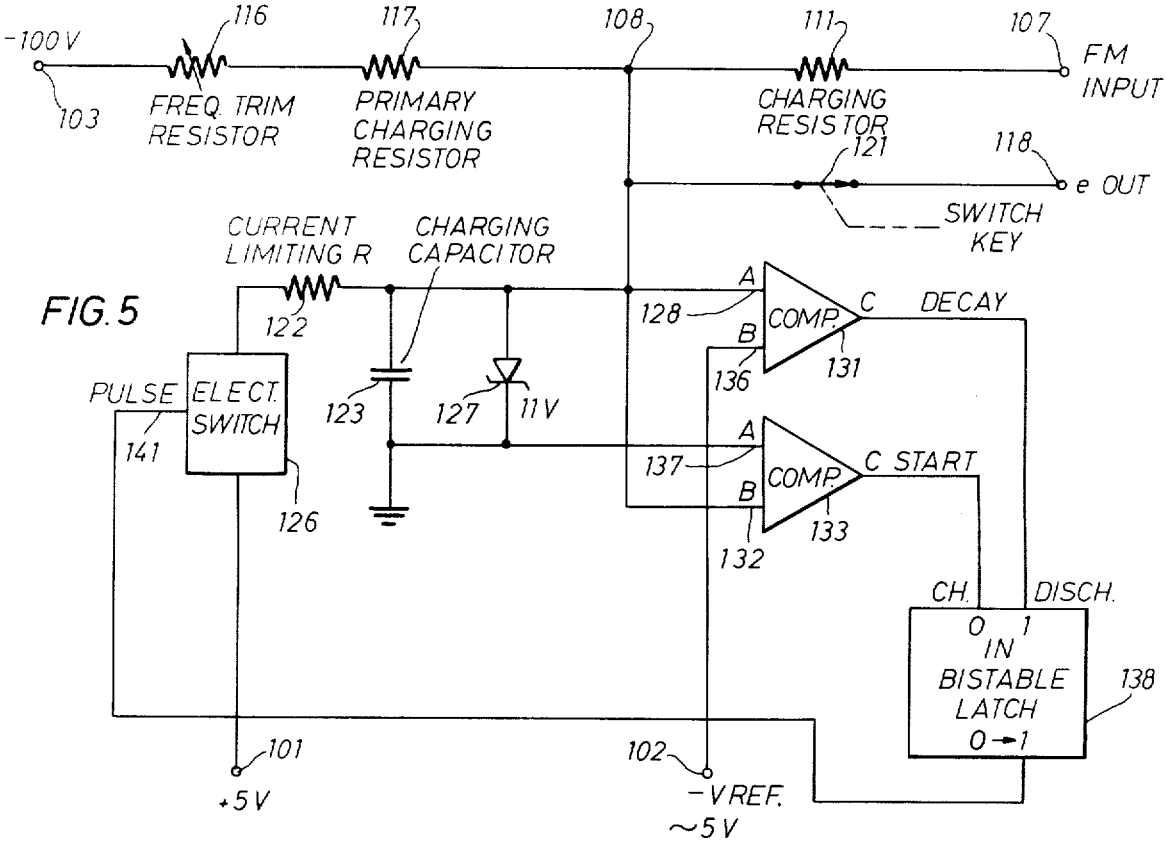
FIG. 5 is a circuit schematic of a sawtooth waveform generator utilized in the circuitry of FIG. 4.
Figure 6:
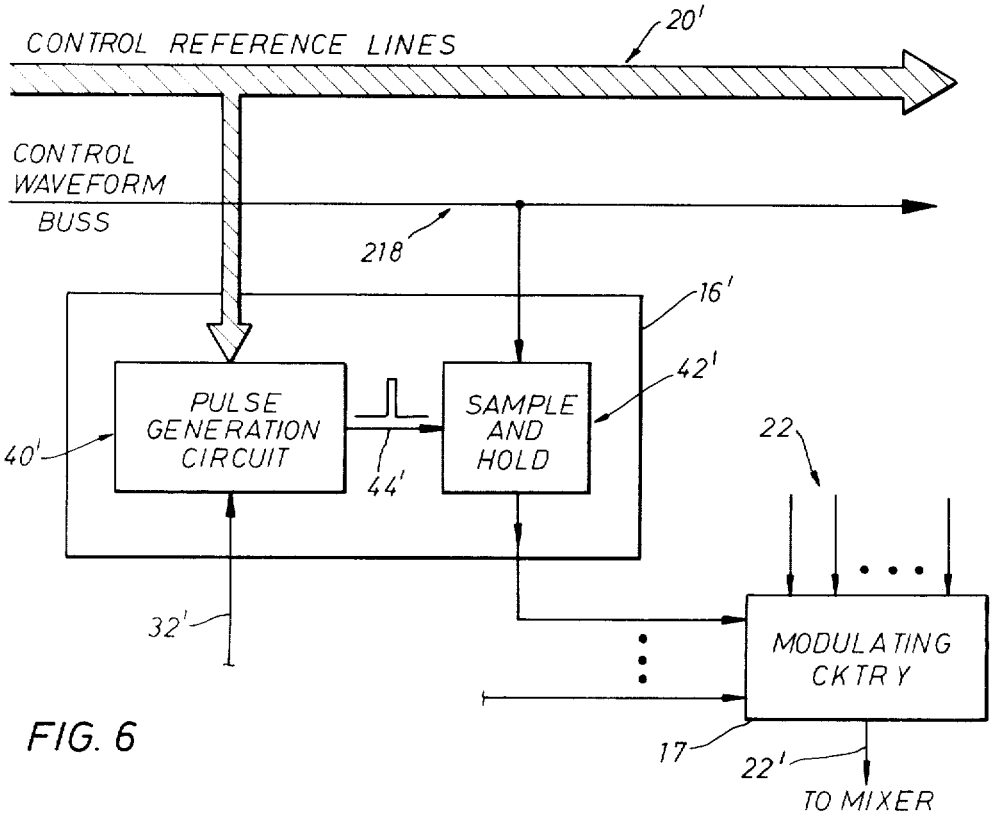
FIG. 6 is a functional block diagram of circuitry utilized in the synthesizer of FIG. 1.

Referring to FIG. 5, there is shown in more detail the sawtooth generator 81, which includes terminals 101 and 102 connected to positive and negative sources, respectively, having nominal values of approximately 5 volts d.c. The value of the negative voltage on terminal 102 can be used to regulate the instantaneous maximum of the low frequency sawtooth waveform prior to comparison with the high frequency sawtooth waveform. Terminal 103 is connected to a negative source which may have a value on the order of 100 volts d.c. and which provides operating voltages for the sawtooth generator 81.

An F.M. input terminal 107, the purpose of which will be more fully understood from the discussion below is connectable to a node 108 through a resistor 111. The terminal 103 is connected to the node 108 through an adjustable resistor 116 and a resistor 117.

An output terminal 118 of the sawtooth generator 81 may be connected to the node 108 through a keyboard operated switch contact 121 which may be closed when a selected key on the keyboard represented by the pitch controller 36 is depressed to play a selected note.

An RC circuit which includes a resistor 122 and a capacitor 123 is connected in series with an electronic switch 126 which may be, for example, a transistor, triac, silicon controlled rectifier or other suitable switching device including a relay. A Zener diode 127 is connected acorss the capacitor to clamp the voltage thereacross to a predetermined value, for example, 11 volts, in order to prevent damage to comparators 131 and 133 due to equipment malfunction. One side of the capacitor 123 and the anode of the Zener diode 127 is connected to a first input 128 of a comparator 131 and a second inverting input 132 of a comparator 133 which are also coupled to the node 108 and the output terminal 118 when switch 121 is closed.

An input 136 of the comparator 131 is connected to the terminal 102 which, as mentioned previously, has a small negative d.c. reference voltage, for example, 5 volts applied thereto. An input 137 of the comparator 133 is connected to the system ground, to which the other side of the capacitor 123 and the Zener diode 127 are also connected. The outputs of the comparators 131 and 133 are respectively connected to the "0" and "1" inputs of a bistable latch 138 which has its "1" output connected to the gate electrode 141 of the electronic switch 126.

In operation the capacitor 123 starts to charge to the voltage established at the terminal 103 through the combination of the adjustable resistor 116 and the resistor 117. The rate of charge, and thus the frequency of the sawtooth generator may be adjusted by varying the value of the resistor 116. Since the value of the voltage established at the terminal 103 is much larger than the voltage rating of the Zener diode 127, the latter acts to clamp the charging voltage across the capacitor 123 to the Zener diode value, for example, 11 volts, should the charge on the capacitor 123 tend to exceed the value of the Zener diode 127.

As the capacitor 123 charges negatively, the input 132 of the camparator 133 tends to become more positive, causing the output of the comparator 133 to become more negative to condition the bistable latch 138 for operation. As the capacitor 123 charges, the input 128 of the comparator 131 becomes more negative until it exceeds the nominal value of the reference voltage at the input 136. At this time the comparator 131 produces an output signal driving the "1" output of the bistable latch 138 high to trigger the electronic switch 126 to discharge the capacitor 123 through the resistor 122, the resistor 122 has a small value and serves to protect the electronic switch 126 from discharge current surges. When the input 132 of comparator 133 goes more positive than the other input 137, the output of comparator 133 goes high and thereby resets the bistable switch 138 to the "0" position. This opens the switch 126 to thereby once again begin the charging of capacitor 123.

The reference high frequency sawtooth signal on the buss line 20 is compared to the low frequency sawtooth signal appearing at the output 118 of the sawtooth generator 81 when the key operated switch contact 121 is closed by depressing the appropriate key on the pitch controller 30. The inhibiting signals generated by the positive-going detector 92 and an inhibiting signal generated by the generator 14 to appear on a line 20c of the buss line 20 assure that the output of the AND gate 87 produces pulses having a duration determined by the time during which the instantaneous high frequency sawtooth signal level is approximately equal to the instantaneous level of the low frequency sawtooth signal. This time is dependent upon the width of the voltage window of the comparator.

This described technique of sawtooth generation is preferably utilized so that the maximum and minimum of both the high and low frequency sawtooth signals must be relatively closely held within the same selected boundaries. Otherwise, a uniform and complete sampling of the master waveform would not be achieved.

Referring again to FIG. 4, the pulsed output of the AND gate 87 triggers first and second sampling circuits 141 and 142 at the inputs thereof. The circuits 141 and 142 function as the sample and hold circuitry 42 shown in FIG. 1. The sampling circuits 141 and 142 are coupled, respectively, to lines 20a and 20b of the buss line 20. The generator 14 generates high frequency timbre signals on the lines 20a, 20b, and the sampling circuits 141 and 142 sample the high frequency timbre signals at a rate determined by the frequency of the sawtooth generator 81 and the reference signals. These waveforms appear at the outputs of the sampling circuits 141 and 142 in audio form characteristic of the sustained reproduction of the tone, sound or musical instrument they represent.

Since the uninhibited trigger pulses from the gate 87 are applied over varying portions of each cycle of the high frequency sawtooth signal at a rate controlled by the high frequency sawtooth reference signal, the timbre signals on the buss lines 20a and 20b are sampled at a rate determined by the high frequency reference waveform whenever the key associated with the contact 121 (FIG. 5) of the low frequency sawtooth generator associated is depressed.

The effect of the foregoing triggering scheme is to sample the timbre signals appearing on the buss lines 20a and 20b and to reassemble the sampled portions thereof at the outputs of the sampling circuits 141 and 142. When the timbre signals are reassembled, they maintain their original waveshapes over successive cycles, but have a frequency much lower than the frequency at which they appear on the buss lines. This frequency is determined in each SPM 16 by the low frequency sawtooth generator 81. As mentioned previously, the frequencies of the low frequency sawtooth generators in each SPM 12 differ in pitch. The result is that the two selected timbre signals are available at the outputs of the sampling circuits 141 and 142 in audio form.

Waveforms produced in the above described manner may be shaped and modified to achieve differing signal characteristics. For example, amplitude, frequency, and timbre modulation may be employed for shaping the reconstructed audio waveform. Wave shaping of this type is generally implemented for the duration of a specific note called for by depression of a key of the pitch controller 30. This wave shaping, or control as it will be hereafter called, usually consists of a variable voltage which is generally produced as an aperiodic waveform, with the beginning of the waveform coincidental with the depression of the key on the controller 30. This variable voltage is produced by control signal processing modules (hereafter referred to as CSPM) 16' (see FIG. 1).

When utilizing the CSPM's 16', a set of modulators 17 for the CSPM's 16 are employed. Rather than inputting the reconstructed audio signal on the lines 22 directly into the mixer 34 as previously described, the reconstructed auido waveform from the various SPM's 16 are input into the corresponding modulators 17. Each modulator 17 is also coupled to the associated CSPM 16' for producing the modulated, reconstructed audio signal on a set of lines 22' for input into the mixer 34. As is apparent from FIG. 1, each CSPM 16' is also responsive to a master waveform and a reference signal. The master waveform is generated by control waveform generator 212 which may be constructed in a manner similar to that of the generator 12, and the reference signal preferably is, but need not be, generated by the generator 14 on the corresponding buss lines 20'. The generators 14, 212 are synchronized by way of a line 213. The control waveform generator produces a high frequency, periodic, complex waveform on a line 218.

Referring again to FIG. 4, a CSPM 16' for use with the analog pulse generating circuitry 40 shown in FIG. 4 is depicted.

A ramp generator 143 has one output coupled to a first input of a comparator 144 which has its other input coupled to the reference sawtooth buss line 20. The comparator 144 has its output coupled to an input of an AND gate 147 which has its output coupled to three sampling circuits 151, 152 and 153, which also receive, respectively, the outputs from a set of lines 20*d*, 20*e*, 20*f* included within the buss line 20. The reference signal generator 14 generates on these lines aperiodic signals.

The AND gate 147 has two inverted inputs coupled, respectively, to the inhibit buss line 20*c* and to the output of a second positive-going detector 158, having its input coupled to the output 101 of the ramp generator 143.

Specifics of the ramp generator 143 are found in Ser. No. 601,509, which has been incorporated by reference.

The output of the ramp generator 143 starts at zero when its key contacts are closed. When the key associated therewith at the pitch controller 36 is depressed, the generated ramp output rises at the established rate. Should the key be released before the output of the ramp generator 143 reaches a predetermined level, Vl, the output voltage continues to rise until it reaches its maximum level Vm and then drops to zero.

If the key should be held down at the time the level Vl is reached, the output of the ramp generator 143 remains at the level Vl until the key is released. At this time the voltage output of the ramp 143 begins to rise at its initial rate until it reaches the level Vm when it drops to zero for recycling.

The output of the ramp generator 143 and the reference high frequency sawtooth signal on the buss line 20 are compared by the comparator 144 and appear as trigger pulses at the input of the sample and hold circuits 151, 152 and 153. Because the ramp generator output is aperiodic and is produced only when the key associated with the ramp generator 143 is depressed, the signals on the buss lines 20*d*, 20*e* and 20*f* are reproduced as aperiodic waveforms at the outputs of the sampling circuits 151, 152 and 153.

The outputs of the sample and hold circuits 151, 152 and 153 thus appear as aperiodic functions derived from much higher frequency periodic functions.

The outputs of the timbral sampling circuits 141 and 142 are coupled, respectively, to first inputs of first and second multiplier circuits 160 and 162 having their gains controlled by the output of the sample and hold circuit 153. The output of the sampling circuit 153 is designed to fall between 0 and +Vl volts, for example, between 0 and +10v. The output is directly coupled to the multiplier 162 and is coupled to the multiplier 160 through an inverting amplifier 164 having unity gain. The outputs of the multipliers 160 and 162 are fed to a summing amplifier 166 coupled to a third multiplier 168 having its output coupled to the mixer 34 through an electronic switch 170. The switch 170 is controlled by the ramp generator 143 and is connected to a gate electrode of the switch 170.

The electronic switch 170 is coupled to the mixer 34 along with the outputs of other such CSPM's 16.

The output signal of the sample and hold circuit 153 is fed directly to one of the inputs of the multiplier 162 while the same signal is fed through the inverting amplifier 164 of unity gain to one of the inputs of the matching multiplier 160. The outputs of the sample and hold circuits 141 and 142 are fed, respectively, into the other inputs of the multipliers 160 and 162. The outputs of the sample and hold circuits 141 and 142 are added so that their sum is always a constant output voltage, for example, 10 volts.

The output signal of the sampling circuit 153 is a timbre modulation control envelope which controls the gain of the two multipliers 160 and 162. ASDR modulation is more or less conventional but the manner in which the aperiodic control envelope is generated and reproduced is believed to be unique because it is derived from a totally periodic function.

The aperiodic envelope produced by the sample and hold circuit 152 is coupled to the terminal 107 of the sawtooth generator 81 through an amplifier 172 to vary the output frequency of the sawtooth generator 81. This, too, is considered to be unique in both its implementation and the sound it produces. Referring back to FIG. 5, the voltage output of the amplifier 172, which appears at the FM input 107 of the ramp generator, changes the charging rate of the capacitor 123 and thus varies the frequency of the output of the sawtooth generator 81.

Referring now to FIGS. 6 and 7 and FIGS. 8*a*–8*c*, digital representations for implementing the CSPM's 16' are shown. Similar to the functional block diagram of the SPM 16, the CSPM's 16' each include a pulse generation circuit 40' and a sample and hold circuit 42'. The pulse generation circuit 40' is responsive to a set of control signals on the buss 20' and to another control signal on a line 32 from the pitch controller 30 (FIG. 1). When the control signal from the pitch controller is generated, for example by the actuation of a key, the pulse generation circuit 40' generates enough sample pulses on a line 44' to the sample and hold circuit 42' such that one complete waveform is contructed. The time period of this aperiodic waveform corresponds to the duration of the specific note played. Further the aperiodic waveform has a wave shape similar to that of the high frequency signal on the buss 20'.

One circuit for digitally implementing the pulse generation circuit 40' is shown in FIG. 7. A seven bit comparator 220 has one set of input terminals coupled to the buss lines 20' from the reference signal generator 14 for receiving the high frequency reference signal. The other set of input terminals from the comparator 220 is coupled to a set of lines 222 and generates the sample pulses on the line 44' upon coincidence of the signals on the lines 222, and 20'.

FIG. 8b represents a typical complex control waveform generated on the buss 20', and FIG. 8c represents the sample pulses generated on the line 44'. To create the aperiodic waveform (FIG. 8a) corresponding to one cycle of the complex waveform on the buss 20', samples are taken of the complex waveform at points 46'. The intersample period is equal to the period of the complex control waveform ± a small increment in time, in a manner similar to the generation of the sample pulses within the SPM's 16.

For generating the appropriate signals on the lines 222, a binary counter 224, a monostable multivibrator 226, and an oscillator 228 are provided. The oscillator 228 is coupled to the counting input of the counter 224 via a three input OR gate 230. The monostable multivibrator 226 is directly coupled to the reset terminal of the counter 224, and has its input terminal coupled to a switch 232. The switch 232 is actuated in response to a signal on a line 38' from the pitch controller 30.

The switch 232 is also connected to one input terminal of a dual input AND gate 234 and to an inverting input terminal of a three input AND gate 236. Another AND gate 238 has its inputs coupled to the lines 222 and has its output terminal coupled in parallel to the other input terminal of the gate 234 and to an input terminal of the gate 236. A line 240 connects the highest order bit line of the lines 222 to the gate 236. The output of the gate 236 is connected by a line 242 to the gate 230. The third input terminal of the gate 230 is coupled by a line 244 to the output terminal of the gate 234.

In operation, when the key in the pitch controller 30 is closed to close the switch 232, the multivibrator 226 provides a reset pulse to the counter 224. This reset pulse resets the counter 224, which in turn, places a low value signal on the lines 222. The positive going signal also is coupled to the gate 236 which renders its output low.

At this time, the OR gate 230 allows a signal transition to be passed from the oscillator 228 to the input of the counter 224. This causes counting to begin, with a value placed on the lines 222. As the binary counter 224 continues to count, the value of its input signal on the lines 222 is compared with the incoming complex reference signal by the comparator 220. When both counts are equal, the comparator 220 produces an output pulse as one of the sample pulses on the line 44'.

when the counter 224 generates a count equal to 63, the AND gate 238 generates a high level signal to the input of the AND gate 234, which in turn, places a high level signal on the input of the OR gate 230. The counter 224 is thereby disabled from the oscillator 228. This condition occurs only when the switch 232 has remained closed for the duration of the note. The resulting halt in the binary count causes an unchanging count to be compared with the complex control reference value by the comparator 220. This condition produces an indefinite number of sample pulses to occur for sampling the complex control wave form at a particular half way point along its length. Such midpoint sampling is used to sustain notes when release of the controlling key in the controller 30 is delayed.

If key release in the controller 30 occurs prior to the count of 63, the aperiodic control wave form continues until a count of 127 is reached. At this point, the reconstructed control waveform is usually at a zero level value where it remains.

Thus, if the pitch controller 30 only momentarily calls for a note, the CSPM 16' generates one full, uninterrupted cycle of its complex control waveform for modulating the reconstructed audio signal. If, however, the controller 30 calls for the note longer than a predetermined time (the count to 63), one-half of the aperiodic complex control waveform is generated and is then maintained at the half way level until the controller 30 calls for the end of the note. In any event, a single, aperiodic signal is generated for modulating the audio frequency signal upon each actuation of a key of the controller 30.

Although rather specific embodiments of the present invention have been described, it is understood that such description has been by way of example only. Numerous changes and modifications to the circuitry will be obvious to those of ordinary skill in the art without departing from the spirit and scope of the invention as hereinafter claimed.

What is claimed is:

1. An electronic sound synthesizer for generating a selected signal waveform at a desired audio frequency F2, comprising:

(a) a signal generator for generating a periodic signal at a relatively higher frequency F1 than the audio frequency F2 and having a waveshape similar to that of said desired signal waveform;

(b) a sampling circuit for repetitively sampling said periodic signal to thereby provide a series of samples, successive ones of the samples being produced by sampling said periodic signal at a rate of approximately once per a given cycle at instantaneous points in the cycle which are progressively displaced from the previously sampled points;

(c) a storage mechanism for storing said samples; and (d) means for sequentially recombining each of said samples to thereby produce said selected waveform at the desired audio frequency F2.

2. The electronic sound synthesizer according to claim 1 wherein said sampling circuit includes a timing mechanism for effecting periodic sampling of said high frequency signal such that successive samples correspond to points on said signal which are equally time displaced from the previously sampled point.

3. The electronic sound synthesizer according to claim 1 wherein said sampling circuit includes means for effecting sampling of said signal at a frequency Fs according to the relationship $Fs=F1\pm F2$.

4. The electronic sound synthesizer according to claim 1 wherein said storage mechanism includes a sample and hold circuit for successively storing and providing each of said samples until the next sample in the series is produced.

5. The electronic sound synthesizer according to claim 1 wherein said sampling circuit includes a timing circuit for generating timing pulses which determine when to sample said high frequency signal, said timing circuit including:

(a) means for generating a first repetitive signal having cyclically varying values at a frequency corresponding to said relatively high frequency F1;

(b) means for generating a second repetitive signal having cyclically varying values at a frequency substantially equal to the audio frequency at which said selected signal waveform is to be synthesized; and (c) means for comparing said first and second repetitive signals and for generating the timing pulses in response to the substantial coincidence of said first and second repetitive signals.

6. The electronic sound synthesizer according to claim 5 wherein said means for generating the second repetitive signal includes a binary counter.

7. The electronic sound synthesizer according to claim 5 wherein said means for generating the second repetitive signal includes a capacitor which is alternately charged and discharged.

8. An electronic sound synthesizer for producing from a relatively higher frequency signal a selected waveform in the audio frequency range, which comprises:

(a) means, including a storage mechanism for repetitively sampling said higher frequency signal at a rate of approximately once per a given cycle in response to a keying signal to thereby provide a series of stored samples;

(b) means for sequentially recombining the samples at a frequency within the audio range to thereby produce said selected waveform in the audio frequency; and (c) a keying signal generator for generating the keying signal such that successive ones of the samples are produced by sampling said higher frequency signal at instantaneous points which are progressively displaced from the previously sampled points, the keying signal generator generating said keying signal at a frequency slightly different from the frequency of said higher frequency signal.

9. The electronic sound synthesizer according to claim 8 wherein said keying signal generator includes:

(a) a binary counter operated at a count rate substantially different from the frequency of said high frequency signal; and (b) a comparator for comparing the output of said counter with said high frequency signal to generate said keying signal.

10. The electronic sound synthesizer according to claim 8 where said keying signal generator includes:

(a) a sawtooth signal generator operating at a frequency substantially different from the frequency of said high frequency signal; and (b) a comparator for generating said keying signal in response to the substantial coincidence of said sawtooth signal and said high frequency signal.

11. A method for generating electronic sounds from an above-audio frequency F1 waveform to produce a desired signal waveform at a desired audio frequency F2, comprising the steps of:

(a) generating a sampling signal at a frequency of $F1 \pm F2$;

(b) sampling said high frequency signal at times determined by said sampling signal, said high frequency signal thereby being sampled at a rate of approximately once per any given cycle thereof;

(c) sequentially storing said samples; and (d) sequentially recombining each of said samples to thereby produce the selected signal waveform at the audio frequency F2.

12. The method according to claim 11 wherein said step of generating a sampling signal includes the steps;

(a) generating a first repetitive signal having cyclically varying values at a frequency corresponding to said relatively high frequency;

(b) generating a second repetitive signal having cyclically varying values at a frequency substantially equal to the frequency F2; and (c) generating said sampling signal substantially upon the coincidence of said first and second repetitive signals.

13. The method according to claim 12 wherein the steps of generating the repetitive signals include the steps of generating said first and second repetitive signals as digital signals.

14. The method according to claim 12 wherein said step of generating the repetitive signals includes the steps of generating said first and second repetitive signals as analog signals.

15. A method for electronically synthesizing sound which comprises:

(a) generating a plurality of waveforms periodically at a common frequency substantially above the audio range;

(b) simultaneously sampling said waveforms at a high frequency rate over an entire cycle to provide approximately one sample per any given cycle and combining said samples to produce identical waveforms at an audio rate;

(c) generating a waveform representative of the transient characteristics of a selected sound at a frequency substantially above the audio range;

(d) sampling said transient waveform at an aperiodic rate;

(e) modulating said waveforms produced at said audio rate in accordance with said sampled transient;

(f) mixing said modulated audio waveforms; and (g) reproducing the sounds represented by said mixed audio waveforms.

16. A method for electronically synthesizing sound to produce a selected waveform at a preselected frequency F1 in the audio frequency range, said method comprising:

(a) sequentially sampling a waveform at a frequency higher than F1 and having a wave shape which it is desired to synthesize in the audio range, said sequential samples being taken at a rate of approximately one sample per a given cycle at instantaneous points spaced differently from the beginning of the waveform than was the next prior sample;

(b) storing each of said higher frequency waveform samples until the next sample in said sequence is taken; and (c) sequentially recombining each of said samples to produce an output signal of the substantially identical shape as said higher frequency waveform but at the preselected audio frequency F1.

17. A method for electronically synthesizing sound as set forth in claim 16 wherein said sequential sampling step includes:

(a) generating a first repetitive signal at a relatively high frequency;

(b) generating a second repetitive signal having a frequency approximately equal to the audio frequency signal to be synthesized;

(c) continuously comparing said first and second signals; and (d) sampling said waveform in response to substantial coincidence of said signals.

18. A method for electronically synthesizing sound as set forth in claim 16 wherein:

(a) a plurality of different high frequency waveforms are sampled and stored simultaneously.

19. A method for electronically synthesizing sound as set forth in claim 18 wherein at least two high frequency waveforms are simultaneously sampled sequentially;

(a) each of said two high frequency waveform samples are sequentially recombined into at least two audio frequency waveforms; and which includes the additional steps of:

(b) sequentially recombining each of said individual sampled waveforms; and (c) mixing said individual recombined audio frequency waveforms into a single audio output signal.

20. An electronic sound synthesizer for producing a selected waveform in the audio frequency range, which comprises:

(a) means for sequentially sampling a high frequency waveform having a wave shape which it is desired to synthesize in the audio range, said sequential samples being taken at instantaneous points differently spaced from the beginning of the waveform than the next prior sample;

(b) means for storing each of said high frequency waveform samples until the next sample in said sequence is taken; and (c) means for sequentially recombining each of said samples to produce an output signal of the identical shape as said high frequency waveform but at a preselected audio frequency;

wherein said means for sequential sampling includes:

(d) means for generating a first repetitive signal having a relatively high frequency;

(e) means for generating a second repetitive signal having a frequency approximately equal to the audio frequency signal to be synthesized;

(f) means for continuously comparing said first and second signals; and (g) means responsive to substantial coincidence of said first and second signals for sampling said waveform.

21. A polyphonic electronic sound synthesizer which comprises:

(a) means for generating a plurality of waveforms periodically at a common frequency substantially above a frequency F1 lying in the audio range;

(b) plural means, each for selectively sampling said waveforms at an audio rate over an entire cycle to produce an identical waveform at said audio frequency F1;

(c) means for generating a waveform representative of the transient characteristics of a selected sound at a frequency substantially above a frequency F2 lying in the audio range;

(d) means for sampling said transient waveform at a periodic rate to produce transient waveform samples;

(e) means for modulating said waveforms produced at said audio frequency F1 in accordance with said transient waveform samples;

(f) audio mixer means for receiving the outputs of said modulating means; and (g) loudspeaker means coupled to the output of said mixer means for reproducing the sounds represented by said audio frequencies.

22. An electronic sound synthesizer comprising:

(a) an audio signal generator for generating an audio frequency signal;

(b) a control signal generator responsive to a periodic waveform for generating an aperiodic signal having substantially the same waveshape as that of one cycle of said periodic waveform; and (c) means for modulating said audio frequency signal with said aperiodic signal to thereby provide a desired tone, wherein said control signal generator includes:

(i) a first reference signal generator for producing a periodic reference signal having a period corresponding to the period of said periodic waveform;

(ii) a second reference signal generator for providing a second reference signal at a frequency relatively slow compared to the frequency of said first reference signal;

(iii) a comparator for generating sampling signals upon the coincidence of said reference signals; and (iv) circuit means responsive to said sampling signals for sampling said periodic waveform to generate samples and for sequentially providing said samples as said aperiodic signal.

23. An electronic sound synthesizer for generating a selected signal waveform at a desired audio frequency F2, comprising:

(a) a signal generator for generating a periodic signal at a relatively higher frequency F1 than the audio frequency F2 and having a waveshape similar to that of said desired signal waveform;

(b) a sampling circuit for repetitively sampling said periodic signal to thereby provide a series of samples, successive ones of the samples being produced by sampling said periodic signal at a rate of approximately once per any given cycle at instantaneous points in the cycle which are progressively displaced from the previously sampled points; and (c) means for sequentially recombining each of said samples to thereby produce said selected waveform at the desired audio frequency F2.

24. An electronic sound synthesizer for generating a selected signal waveform, comprising:

(a) a signal generator for generating a periodic signal at a frequency F1 and having a one-cycle waveshape similar to that of said desired signal waveform;

(b) a sampling circuit for repetitively sampling said periodic signal to thereby provide a series of samples, successive ones of the samples being produced by sampling said periodic signal at a rate of approximately once per given cycle at instantaneous points in the cycle of the periodic signal which are progressively displaced from the previously sampled points; and (c) means for sequentially recombining each of said samples to thereby produce said selected waveform.

25. An electronic sound synthesizer comprising:

(a) an audio signal generator for generating an audio frequency signal;

(b) a control signal generator responsive to a periodic waveform for generating an aperiodic signal having substantially the same waveshape as that of one cycle of said periodic waveform; and (c) means for modulating said audio frequency signal with said aperiodic signal to thereby provide a desired tone, wherein said control signal generator includes:

(i) a sampling circuit for repetitively sampling said periodic waveform to thereby provide a series of samples, successive ones of the samples being produced by sampling said periodic waveform at a rate of approximately once per given cycle at instantaneous points in the cycle of the periodic waveform which are progressively displaced from the previously sampled points; and (ii) means for sequentially recombining each of said samples to thereby produce said aperiodic signal.

* * * * *